US012578167B2

(12) United States Patent
Toy et al.

(10) Patent No.: US 12,578,167 B2
(45) Date of Patent: Mar. 17, 2026

(54) SCOPE TURRET

(71) Applicant: Sheltered Wings, Inc., Barneveld, WI (US)

(72) Inventors: Seth Toy, Barneveld, WI (US); Scott Parks, Barneveld, WI (US); David Hamilton, Barneveld, WI (US); Rob Morell, Barneveld, WI (US)

(73) Assignee: Sheltered Wings, Inc., Barneveld, WI (US)

( * ) Notice: Subject to any disclaimer, the term of this patent is extended or adjusted under 35 U.S.C. 154(b) by 534 days.

(21) Appl. No.: 17/935,675

(22) Filed: Sep. 27, 2022

(65) Prior Publication Data

US 2023/0099212 A1 Mar. 30, 2023

Related U.S. Application Data

(60) Provisional application No. 63/249,221, filed on Sep. 28, 2021.

(51) Int. Cl.
*F41G 1/38* (2006.01)
*F41G 11/00* (2006.01)

(52) U.S. Cl.
CPC ..... *F41G 1/38* (2013.01); *F41G 11/00* (2013.01)

(58) Field of Classification Search
CPC ..... F41G 1/38; F41G 11/00
USPC ..... 359/822
See application file for complete search history.

(56) References Cited

U.S. PATENT DOCUMENTS

| | | | |
|---|---|---|---|
| 8,166,696 | B2 | 5/2012 | Hamilton |
| 8,490,317 | B2 | 7/2013 | Adkins et al. |
| 9,677,848 | B2 | 6/2017 | Hamilton |
| 9,958,666 | B2 | 5/2018 | Ingenito |
| 10,190,848 | B2 | 1/2019 | Vanbecelaere |
| 10,309,749 | B2 | 6/2019 | Hamilton |

(Continued)

FOREIGN PATENT DOCUMENTS

WO 2013078193 A1 5/2013

OTHER PUBLICATIONS

International Search Report and Written Opinion for PCT/US2022/077074, Dated Dec. 13, 2022, 10 pages.

(Continued)

*Primary Examiner* — Stephone B Allen
*Assistant Examiner* — Leonidas Boutsikaris
(74) *Attorney, Agent, or Firm* — Husch Blackwell LLP

(57) ABSTRACT

A riflescope with a scope body has a movable optical element defining an optical axis connected to the scope body. The riflescope also has a turret having an outer knob and a turret screw defining a screw axis and operably connected to the optical element for changing the optical axis in response to rotation of the turret screw. The riflescope also includes a zero-adjustment assembly contained within the turret and operably interfacing with the turret screw. The zero-adjustment assembly comprises a zero-adjustment disc and a locking collar disposed around a downward facing central shaft of the zero-adjustment disc. The zero-adjustment disc is contained in an upper recess of the outer knob. The locking collar has a first position in which the zero-adjustment disc is freely rotatable about the turret screw and a second position in which free rotation of the zero-adjustment disc is prevented.

16 Claims, 16 Drawing Sheets

(56) References Cited

U.S. PATENT DOCUMENTS

| | | | | |
|---|---|---|---|---|
| 2016/0040959 | A1* | 2/2016 | Davidson | F41G 1/38<br>42/122 |
| 2020/0326155 | A1 | 10/2020 | Hamilton et al. | |

OTHER PUBLICATIONS

Extended European Search Report issued for European Patent Application No. 22877495.6 dated Jul. 21, 2025, 10 pages.

* cited by examiner

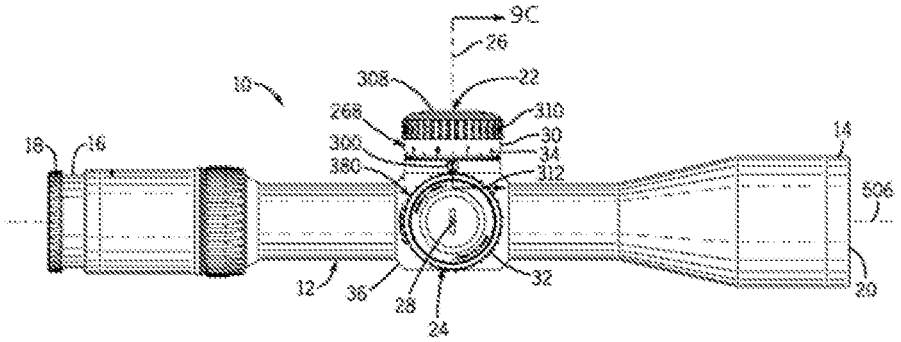
FIG. 1
FIG. 2
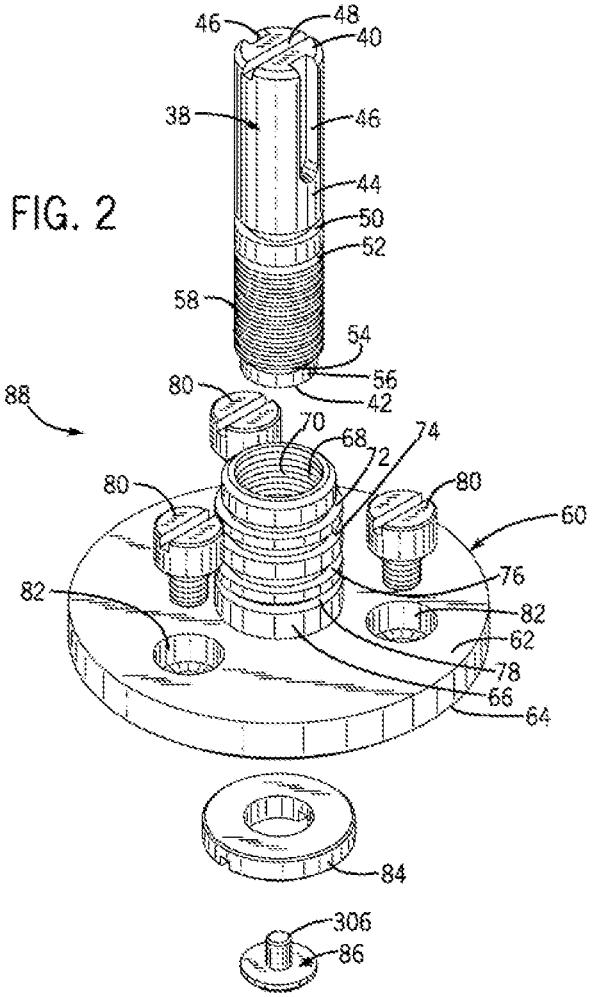

FIG. 5A
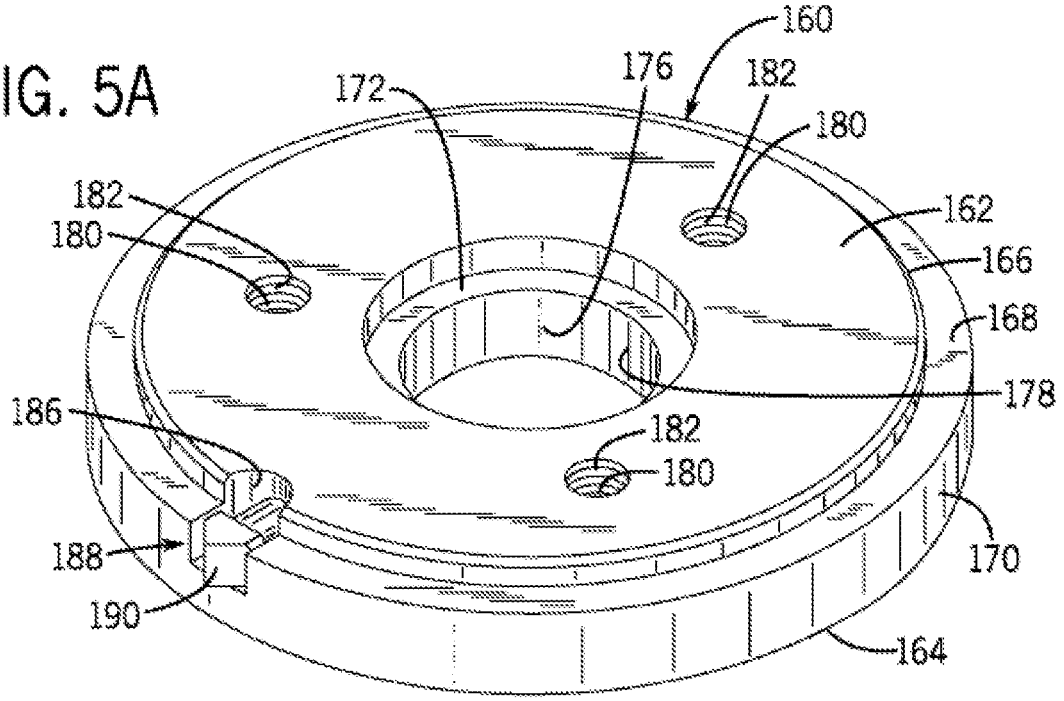
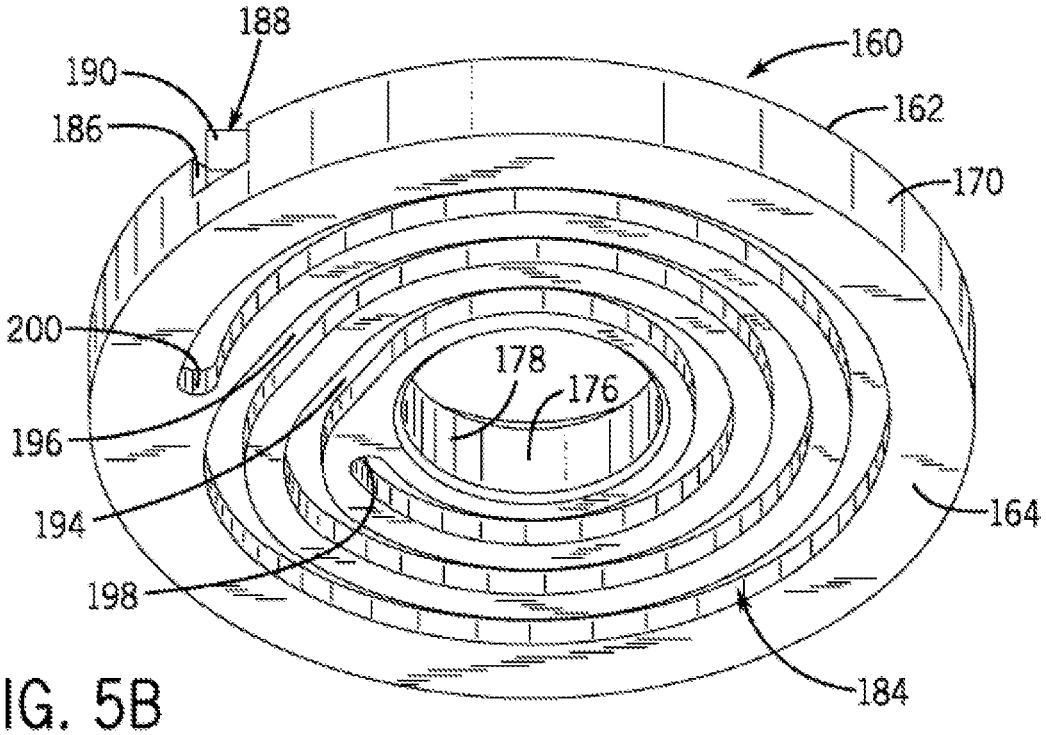
FIG. 5B

SCOPE TURRET

CROSS-REFERENCE TO RELATED APPLICATIONS

This application claims priority to and is a non-provisional patent application of U.S. Provisional Application No. 63/249,221 filed Sep. 28, 2021, which is incorporated herein in its entirety.

FIELD

The disclosure relates generally to the field of optic sighting devices. More particularly, the present invention relates to devices and methods for conveniently adjusting such optics.

BACKGROUND

A turret is one of two controls on the outside center part of a riflescope body. Turrets are marked in increments and are used to adjust elevation and windage for points of impact change. Conventional turrets have markings on them that indicate how many clicks of adjustment have been dialed in on the turret, or an angular deviation, or a distance compensation for a given cartridge. A click is one tactile adjustment increment on the windage or elevation turret of a scope.

In order to achieve accurate sighting of objects at greater distances, the downward acceleration on the projectile imparted by gravity is of significance. The effect of gravity on a projectile in flight is often referred to as bullet drop because it causes the bullet to drop from the shooter's line of sight. For accuracy at longer distances, the sighting components of a gun must compensate for the effect of bullet drop. An adjustment to the angular position of the riflescope relative to the rifle barrel is made using the elevation turret to compensate for bullet drop.

Similarly, any horizontal forces imparted on the projectile, such as wind, is of significance. The effect of wind on a projectile in flight is often referred to as drift because it causes the bullet to drift right or left from the shooter's line of sight. For accuracy at longer distances, the sighting components of a gun must compensate for the effect of drift. An adjustment to the angular position of the riflescope relative to the axis of the rifle barrel is made using the windage turret to compensate for drift.

Riflescopes have recently been developed which include tactile and audible indicators of turret rotation. Using indicators relying on senses other than vision allow a user to remain in position behind a riflescope, therefore decreasing the time required to take an accurate shot. Tactile and audible indicators also aid a user in low light conditions. Once the turret is properly adjusted, the turret is locked down to prevent it from inadvertent changes. Riflescopes also include zero-stop mechanisms which allow a user to easily return a riflescope to the zero position quickly.

In addition to dialing a turret to correct for environmental conditions, another critical task of a riflescope is the zeroing process. Before dialing a turret from a zero point, the "zero point" must actually be set for a given scope, rifle, and ammunition combination. Existing turrets that include some of the features described above (e.g., tactile and audible rotation indicators, zero-stops, etc.) often require intricate methods to zero a scope after mounting it to a rifle. Some scopes require parts to be removed from the scope in order to zero the scope. There are always risks associated with removing parts from a scope, including losing the parts and introducing dirt, debris and/or moisture to the scope. Some scopes also tie the zeroing mechanism to the turret adjustment mechanisms that provide the tactile and audible feedback, meaning users are tied to zeroing in the units of adjustment on the turret (often MRAD or MOA).

Therefore, a need exists for a riflescope with a zeroing structure that is independent of the turret adjustment units and/or does not require parts to be removed from the riflescope.

SUMMARY

In one embodiment, the disclose provides a riflescope. In accordance with embodiments of the disclosure, a riflescope comprises a scope body; a movable optical element defining an optical axis connected to the scope body; a turret having an outer knob and a turret screw defining a screw axis and operably connected to the optical element for changing the optical axis in response to rotation of the turret screw; and a zero-adjustment assembly contained within the turret and operably interfacing with the turret screw, the zero-adjustment assembly comprising a zero-adjustment disc and a locking collar disposed around a downward facing central shaft of the zero-adjustment disc, wherein the zero-adjustment disc is contained in an upper recess of the outer knob.

In one embodiment, the locking collar has a first position and a second position, and wherein the zero-adjustment disc is freely rotatable about the turret screw when the locking collar is in the first position and free rotation of the zero-adjustment disc is prevented when the locking collar is in the second position. In another embodiment, the locking collar comprises a first ring half and a second ring half pivotally joined at respective first ends. In still a further embodiment, the locking collar further comprises a channel extending through respective second ends of the first and second ring halves. In another embodiment, the channel has a first portion having a first internal diameter and a second portion having a second internal diameter, wherein the first internal diameter is less than the second internal diameter. In yet another embodiment, the second portion of the channel is threaded and a screw engages the channel. In a further embodiment, rotation of the screw in a first direction causes pivotal movement of the second ends of the first and second ring halves away from one another to move the locking collar to the first position and rotation of the screw in a second direction causes pivotal movement of the second ends of the first and second ring halves toward one another to move the locking collar to the second position. In yet a further embodiment, the screw is accessible through a side surface of the outer knob.

In one embodiment, the turret is an elevation turret. In another embodiment, the turret is a windage turret.

In one embodiment, the disclosure provides a riflescope. In accordance with embodiments of the disclosure, a riflescope comprises a scope body; a movable optical element defining an optical axis connected to the scope body; a turret having an outer knob and a turret screw defining a screw axis and operably connected to the optical element for changing the optical axis in response to rotation of the turret screw; a stop element connected to the turret screw, the stop element defining a guide surface wrapping about the screw axis and terminating at first and second ends; a cam follower element connected to the scope body and operable to engage the guide surface, and to engage the first and second ends, the engagement of the first and second ends defining the rotational limits of the turret; wherein each of the first and second ends are at different radial distances from the screw axis; wherein the cam follower is moved radially in relation to the screw axis and prevented from rotating; and a zero-adjustment assembly contained within the turret and operably interfacing with the turret screw, the zero-adjustment assembly comprising a zero-adjustment disc and a locking collar disposed around a downward facing central shaft of the zero-adjustment disc, wherein the zero-adjustment disc is contained in a upper recess of the outer knob.

In another embodiment, the locking collar has a first position and a second position, and wherein the zero-adjustment disc is freely rotatable about the turret screw when the locking collar is in the first position and free rotation of the zero-adjustment disc is prevented when the locking collar is in the second position. In yet another embodiment, the locking collar comprises a first ring half and a second ring half pivotally joined at respective first ends. In still another embodiment, the locking collar further comprises a channel extending through respective second ends of the first and second ring halves. In a further embodiment, the channel has a first portion having a first internal diameter and a second portion having a second internal diameter, wherein the first internal diameter is less than the second internal diameter. In another embodiment, the second portion of the channel is threaded and a screw engages the channel. In still another embodiment, rotation of the screw in a first direction causes pivotal movement of the second ends of the first and second ring halves away from one another to move the locking collar to the first position and rotation of the screw in a second direction causes pivotal movement of the second ends of the first and second ring halves toward one another to move the locking collar to the second position. In still a further embodiment, the screw is accessible through a side surface of the outer knob.

In one embodiment, the turret is an elevation turret. In another embodiment, the turret is a windage turret.

In one embodiment, the disclosure provides a riflescope. In accordance with embodiments of the disclosure, a riflescope comprises a scope body; a movable optical element defining an optical axis connected to the scope body; a turret having an outer knob and a turret screw defining a screw axis and operably connected to the optical element for changing the optical axis in response to rotation of the turret screw; and a zero-adjustment assembly contained within the turret and operably interfacing with the turret screw, the zero-adjustment assembly comprising a zero-adjustment disc contained in an upper recess of the outer knob, a locking collar disposed around a downward facing central shaft of the zero-adjustment disc, the locking collar comprising a first ring half and a second ring half pivotally joined at respective first ends and a channel extending through respective second ends of the first and second ring halves, and a screw engaging the channel; wherein rotation of the screw in a first direction causes pivotal movement of the second ends of the first and second ring halves away from one another to move the locking collar to a first position in which the zero-adjustment disc is freely rotatable about the turret screw, and wherein rotation of the screw in a second direction causes pivotal movement of the second ends of the first and second ring halves toward one another to move the locking collar to a second position in which free rotation of the zero-adjustment disc is prevented.

BRIEF DESCRIPTION OF THE DRAWINGS

FIG. 1 is a side view of an embodiment of the riflescope with adjustment stops, in accordance with embodiments of the disclosure.

FIG. 2 is a top perspective exploded view of an elevation turret screw subassembly, in accordance with embodiments of the disclosure.

FIG. 5A is a top perspective view of an elevation cam disc, in accordance with embodiments of the disclosure.

FIG. 5B is a bottom perspective view of the elevation cam disc, in accordance with embodiments of the disclosure.

DETAILED DESCRIPTION

Figure 3:
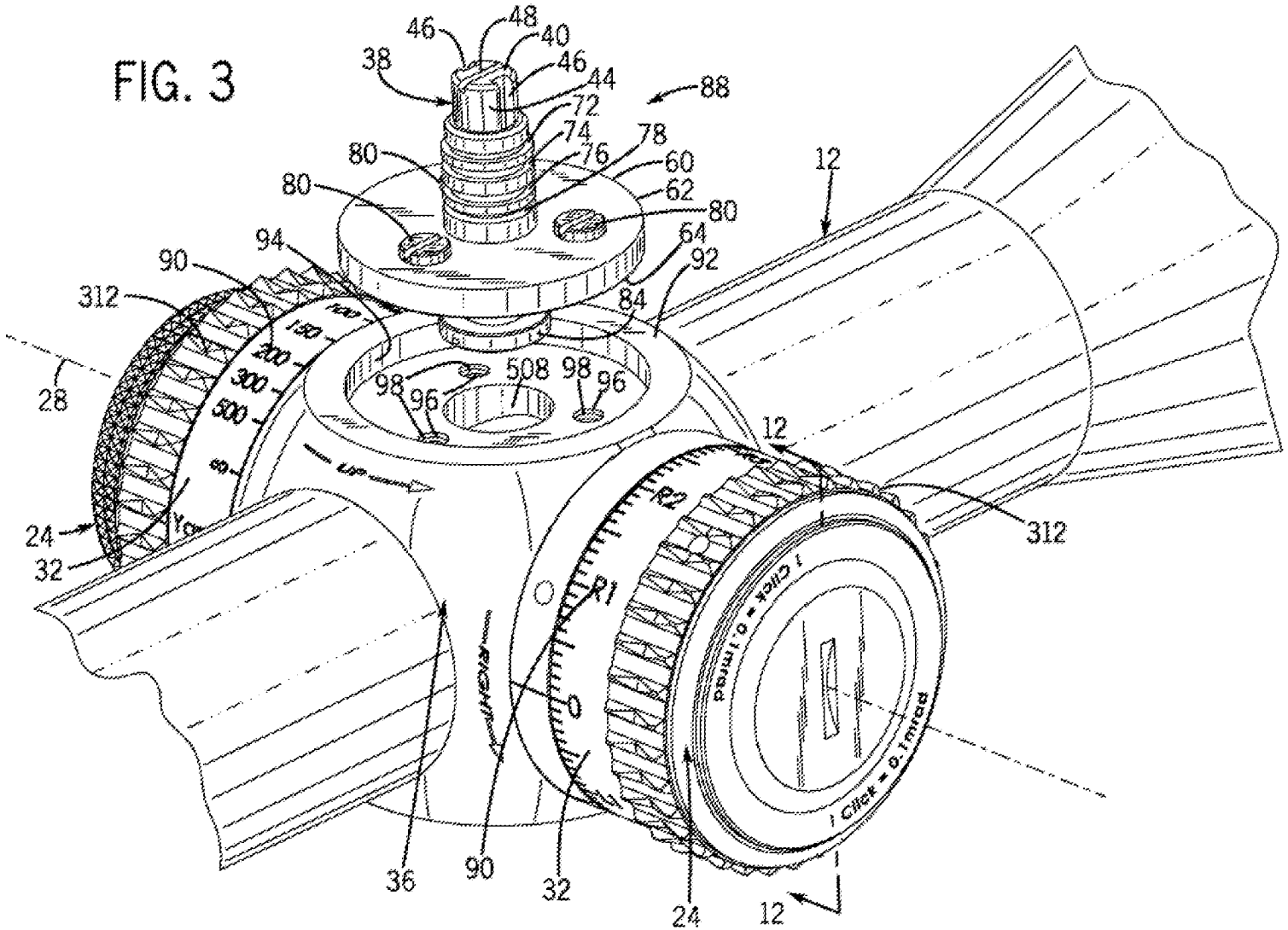
FIG. 3 is a top perspective exploded view of the elevation turret screw subassembly and turret housing, in accordance with embodiments of the disclosure.

An embodiment of the riflescope with spiral cam mechanism is shown and generally designated by the reference numeral 10.

FIG. 1 illustrates one embodiment of an improved sighting device, such as a riflescope with spiral cam mechanism 10. More particularly, the riflescope or a sighting device 10 has a body 12, in the embodiment shown, a scope body, that encloses a movable optical element, which is an erector tube. The scope body is an elongate tube having a larger opening at its front 14 and a smaller opening at its rear 16. An eyepiece 18 is attached to the rear of the scope body, and an objective lens 20 is attached to the front of the scope body. The center axis of the movable optical element defines the optical axis 506 of the riflescope.

An elevation turret 22 and a windage turret 24 are two dials on the outside center part of the scope body 12. They are marked in increments by indicia 34 on their perimeters 30 and 32 and are used to adjust the elevation and windage of the movable optical element 248 for points of impact change. These turrets protrude from the turret housing 36. The turrets are arranged so that the elevation turret rotation axis 26 is perpendicular to the windage turret rotation axis 28. Indicia typically include tick marks, each corresponding to a click, and larger tick marks at selected intervals, as well as numerals indicating angle of adjustment or distance for bullet drop compensation.

The movable optical element 248 is adjusted by rotating the turrets one or more clicks. A click is one tactile adjustment increment on the windage or elevation turret of the riflescope, each of which corresponds to one of the indicia 34. In one embodiment, one click changes the scope's point of impact by 0.1 mrad.

FIG. 2 illustrates a turret screw subassembly 88. In an embodiment, an elevation cam disc 160 is in accordance with the embodiments shown and described in U.S. Pat. No. 8,919,026, herein incorporated by reference in its entirety. More particularly, in an embodiment the turret screw subassembly consists of a turret screw 38, a turret screw base 60, a friction pad 86, and various fasteners. The turret screw is a cylindrical body made of brass in one embodiment. The top 40 of the turret screw defines a slot 48, and two opposing cam slots 46 run from the top part way down the side 44. Two 0-ring grooves 50 and 52 are on the side located below the cam slots. The bottom 42 of the turret screw has a reduced radius portion 56 that defines a ring slot 54. The ring slot 54 receives a retaining ring 84, and a bore 304 in the bottom 42 receives the shaft 306 of the friction pad 86. The side of the turret screw immediately below the 0-ring groove 52 and above the ring slot 54 is a threaded portion 58. In one embodiment, the slot 48 is shaped to receive a straight blade screwdriver, but could be shaped to receive a hex key or any other suitable type of driver.

The turret screw base 60 is a disc-shaped body made of brass in one embodiment. A cylindrical collar 66 rises from the center of the top 62 of the turret screw base. The collar has a turret screw bore 68 with threads 70. The exterior of the collar defines a set screw V-groove 78 above the top of the turret screw base, an 0-ring groove 76 above the set screw V-groove, an 0-ring groove 74 above the 0-ring groove 76, and a ring slot 72 above the 0-ring groove 74. The turret screw base has three mount holes 82 with smooth sides and a shoulder that receive screws 80.

FIG. 3 illustrates the improved turret screw subassembly 88 and turret housing 36. More particularly, the turret screw subassembly 88 is shown assembled and in the process of being mounted on the turret housing 36. The top 92 of the turret housing defines a recess 94. Three mount holes 96 with threads 98 and a smooth central bore 508 are defined in the top of the turret housing within the recess.

The threads 70 of the turret screw bore 68 are fine such that the turret screw bore may receive the threads 58 on the turret screw 38. The retaining ring 84 limits upward travel of the turret screw so that the turret screw cannot be inadvertently removed from the turret screw bore.

When the turret screw subassembly 88 is mounted on the turret housing 36, screws 80 are inserted into the mount holes 82 and protrude from the bottom 64 of the turret screw base 60. The screws are then screwed into the mount holes 96 in the turret housing to mount the turret screw base to the turret housing. Subsequently, the turret screw base remains in a fixed position with respect to the scope body 12 when the elevation turret 22 is rotated. This essentially makes the turret screw base functionally unitary with the scope body, and the turret screw base is not intended to be removed or adjusted by the user. The smooth central bore 508 in the top of the turret housing permits passage of the friction pad 86 and the bottom 42 of the turret screw into the scope body.

Figure 4:
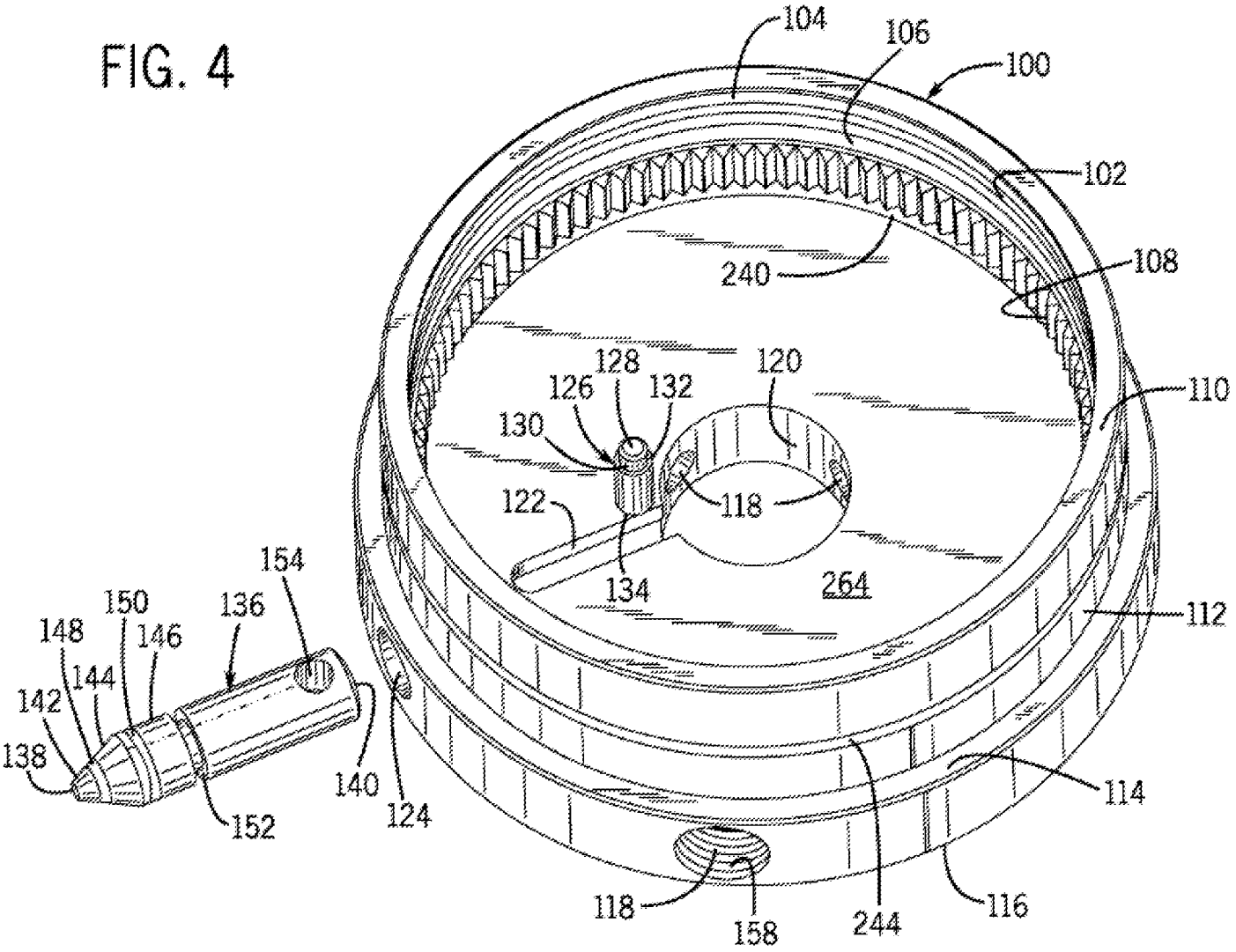
FIG. 4 is a top perspective view of an elevation turret chassis and elevation indicator, in accordance with embodiments of the disclosure.

FIG. 4 illustrates the elevation turret chassis 100. In an embodiment, an elevation cam disc 160 is in accordance with the embodiments shown and described in U.S. Pat. No. 8,919,026. More particularly, the top 110 of the elevation turret chassis has an interior perimeter 102 with a relief cut 240 adjacent to the floor 264, a toothed surface 108 above the relief cut, a lower click groove 106 above the toothed surface, and an upper click groove 104 above the lower click groove. The relief cut is for the tool that cuts the toothed surface. The floor defines a smooth central bore 120 and a slot 122. The smooth central bore permits passage of the friction pad 86 and the bottom 42 of the turret screw through the turret chassis.

The exterior perimeter 112 of the turret chassis 100 defines an 0-ring groove 244. Near the bottom 116 of the turret chassis, the exterior perimeter widens to define a shoulder 114. Three holes 118 with threads 158 communicate from the exterior perimeter through the turret chassis to the smooth bore 120. In one embodiment, the turret chassis is made of steel.

The slot 122 in the floor 264 of the turret chassis 100 communicates with a hole 124 in the exterior perimeter 112 of the turret chassis. The hole 124 receives a rotation indicator, which in this embodiment is an elevation indicator 136. The rear 140 of the elevation indicator defines a cam pin hole 154. The front 138 of the elevation indicator has two stripes 148 and 150 and an 0-ring groove 152. The stripe 148 divides a first position 142 from a second position 144. The stripe 150 divides a second position 144 from a third position 146. In one embodiment, the elevation indicator is made of painted black steel, and the stripes are white lines that do not glow, but which could be luminous in an alternative embodiment.

The cam pin hole 154 receives the bottom 134 of a cam pin 126. In one embodiment, the cam pin is a cylindrical body made of steel. The top 128 of the cam pin has a reduced radius portion 130 that defines a shoulder 132. The reduced radius portion of the cam pin protrudes upward through the slot 122 above the floor 264 of the turret chassis 100.

FIGS. 5A and 5B illustrate an elevation cam disc 160. In an embodiment, an elevation cam disc 160 is in accordance with the embodiments shown and described in U.S. Pat. No. 8,919,026. More particularly, the elevation cam disc is made of steel with a top face 162 and a bottom face 164. The top has a reduced radius portion 166 that defines a shoulder 168 around the exterior perimeter 170 of the elevation cam disc. The top also defines three mount holes 180 with threads 182. A reduced radius central portion 176 defines a shoulder 172 and a smooth central bore 178. The smooth central bore permits passage of the turret screw subassembly through the elevation cam disc.

A radial clicker channel 186 in the top 162 of the exterior perimeter 170 receives a clicker 188 that reciprocates in the channel, and is biased radially outward. The front, free end 190 of the clicker protrudes from the exterior perimeter. In one embodiment, the clicker has a wedge shape with a vertical vertex parallel to the axis of rotation of the turret and is made of steel.

The bottom 164 of the elevation cam disc 160 is a planar surface perpendicular to the elevation turret rotation axis 26 that defines a recessed spiral channel 184. The spiral channel terminates in a zero stop surface 198 when traveled in a clockwise direction and terminates in an end of travel stop surface 200 when traveled in a counterclockwise direction. When traveled in a counterclockwise direction, the spiral channel defines a first transition 194 and a second transition 196 when the spiral channel begins to overlap itself for the first time and second time, respectively. The spiral channel is adapted to receive the reduced radius portion 130 of the cam pin 126. The spiral channel and the stop surfaces are integral to the elevation cam disc and are not adjustable.

Figure 6:
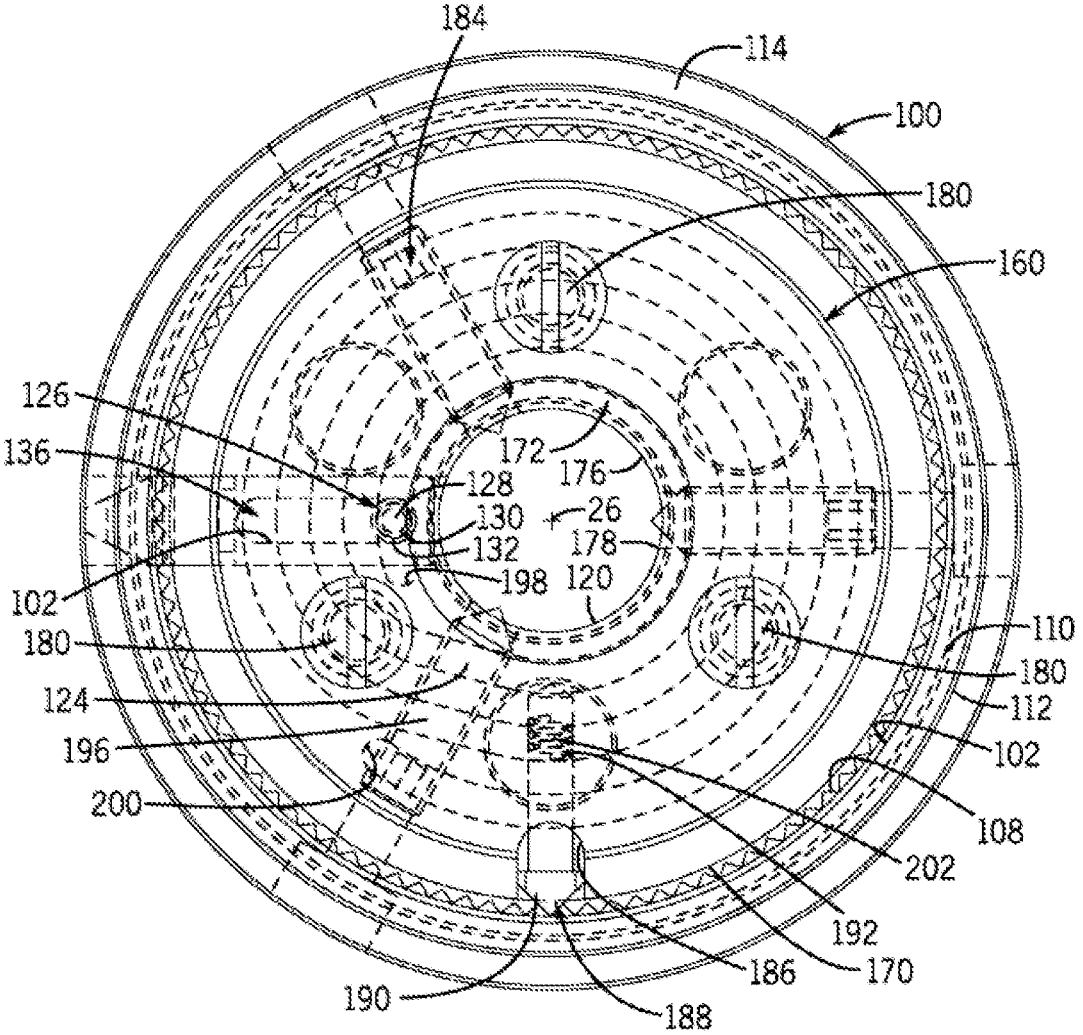
FIG. 6 is a top view of the elevation cam disc inserted into the elevation turret chassis with the elevation cam disc rendered partially transparent, in accordance with embodiments of the disclosure.

FIG. 6 illustrates an elevation cam disc 160 and turret chassis 100. In an embodiment, an elevation cam disc 160 and turret chassis 100 is in accordance with the embodiments shown and described in U.S. Pat. No. 8,919,026. More particularly, the elevation cam disc is shown installed in the turret chassis. The spiral channel 184 receives the reduced radius portion 130 of the cam pin 126. The clicker 188 protrudes from the clicker channel 186 in the exterior perimeter 170 of the elevation cam disc. A spring 202 at the rear 192 of the clicker outwardly biases the clicker such that the clicker is biased to engage with the toothed surface 108 on the interior perimeter 102 of the turret chassis. When the elevation cam disc rotates as the elevation turret 22 is rotated when changing elevation settings, the clicker travels over the toothed surface, thereby providing a rotational, resistant force and making a characteristic clicking sound.

In one embodiment, the toothed surface 108 has 100 teeth, which enables 100 clicks per rotation of the elevation turret 22. The spiral channel 184 is formed of a several arcs of constant radius that are centered on the disc center, and extend nearly to a full circle, and whose ends are joined by transition portions of the channel, so that one end of the inner arc is connected to the end of the next arc, and so on to effectively form a stepped spiral. This provides for the indicator to remain in one position for most of the rotation, and to transition only in a limited portion of turret rotation when a full turret rotation has been substantially completed. In another embodiment, the spiral may be a true spiral with the channel increasing in its radial position in proportion to its rotational position. In the most basic embodiment, the channel has its ends at different radial positions, with the channel extending more than 360 degrees, the ends being radially separated by material, and allowing a full 360 degree circle of rotation with the stop provided at each channel end.

The elevation turret 22 is positioned at the indicium 34 corresponding to 0° of adjustment when the cam pin 126 is flush with the zero stop surface 198. In one embodiment, the spiral channel 184 holds the cam pin 126 in a circular arc segment at a constant distance from the rotation axis 26 until the elevation turret has rotated 9 mrad (324°). The first transition 194 occurs as the elevation turret rotates counterclockwise from 9 mrad (324°) to 10 mrad (360"). During the first transition, the spiral channel shifts the cam pin 126 towards the exterior perimeter 170 so the spiral channel can begin overlapping itself. As the elevation turret continues its counterclockwise rotation, the spiral channel holds the cam pin 126 in a circular arc segment at a constant further distance from the rotation axis 26 until the elevation turret has rotated 19 mrad (684°). The second transition 196 occurs as the elevation turret rotates counterclockwise from 19 mrad (684°) to 20 mrad (7200°). During the second transition, the spiral channel shifts the cam pin 126 even further towards the exterior perimeter 170 so the spiral channel can overlap itself a second time. As the elevation turret continues its counterclockwise rotation, the spiral channel holds the cam pin 126 in a circular arc segment at a constant even further distance from the central bore 178 until the elevation turret has rotated 28.5 mrad (1026°). At that time, the cam pin is flush with the end of travel stop surface 200, and further counterclockwise rotation of the elevation turret and elevation adjustment are prevented. In one embodiment, the first and second transitions are angled at about 36° (10% of the rotation) to enable adequate wall thickness between the concentric circular arc segments about the rotation axis 26 of the spiral channel. The cam pin diameter determines the overall diameter of the turret. Because there are three rotations, any increase in diameter will be multiplied by three in how it affects the overall turret diameter. In the preferred embodiment, a cam pin diameter of 1.5 mm provides adequate strength while remaining small enough to keep the overall diameter of the turret from becoming too large.

Figure 7A:
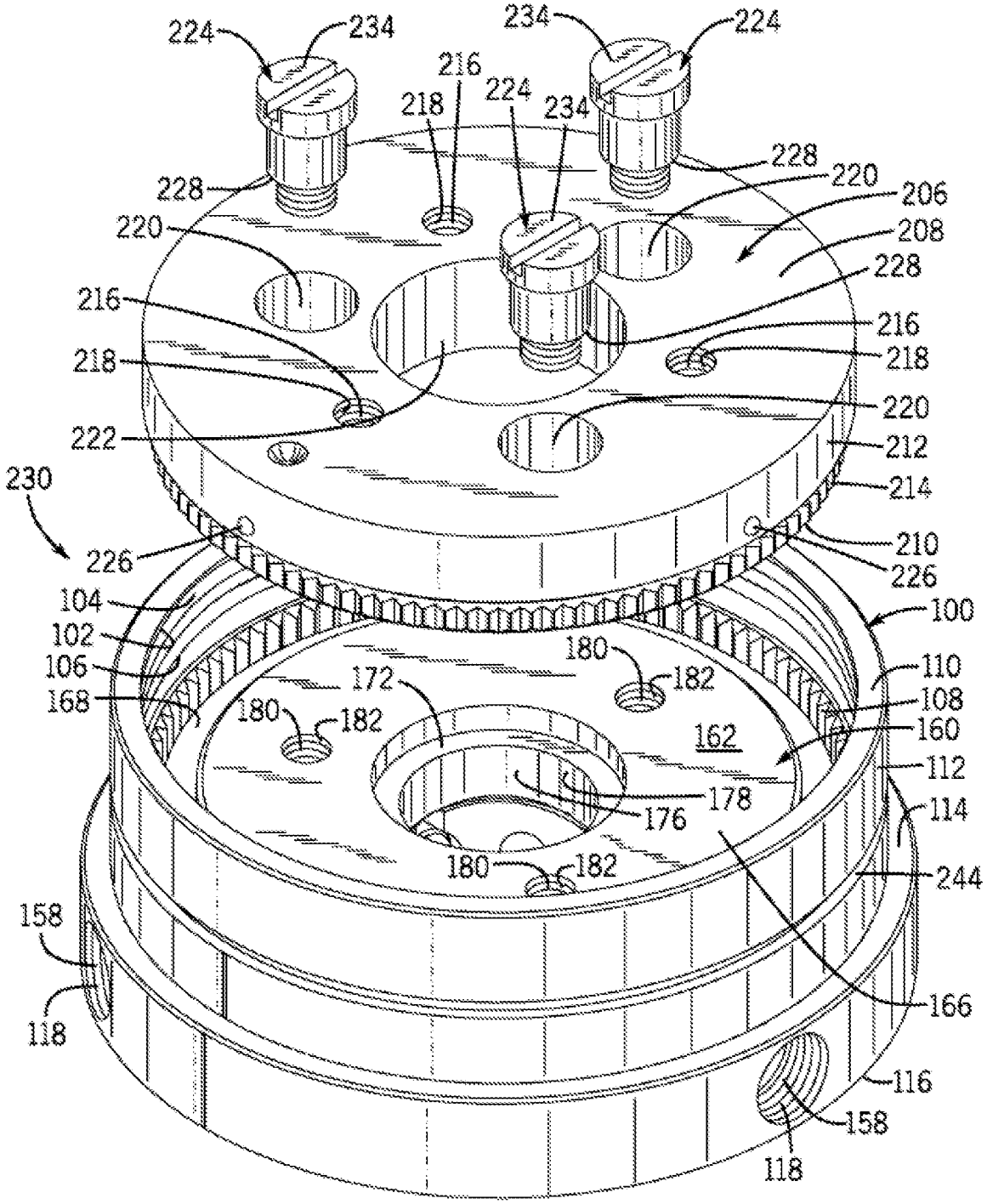
FIG. 7A is a top perspective exploded view of the elevation turret chassis subassembly, in accordance with embodiments of the disclosure.
Figure 7B:
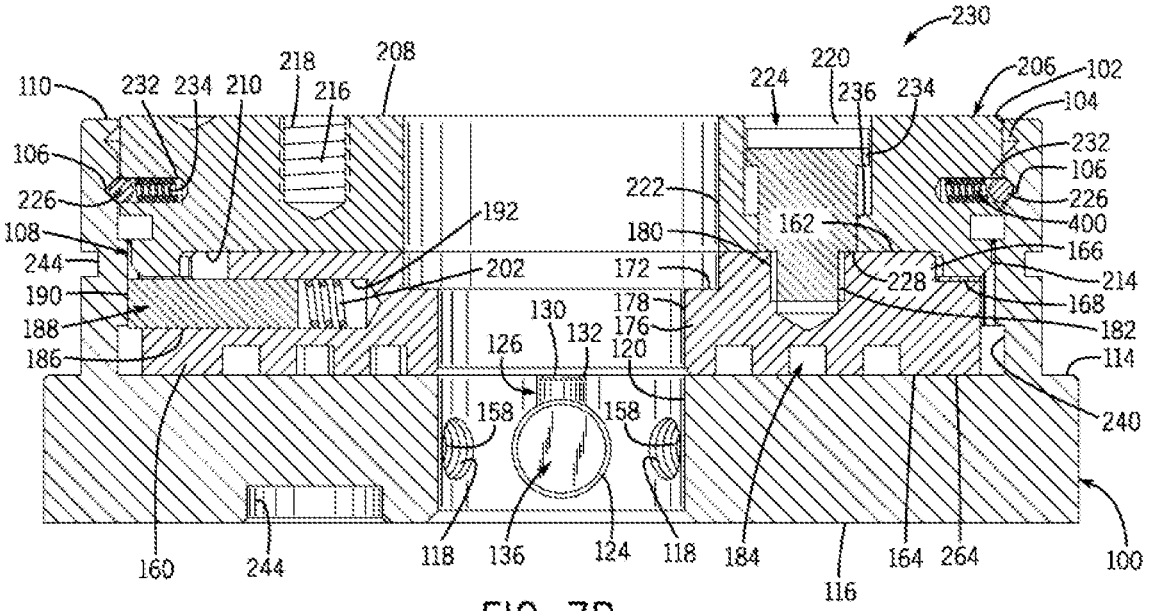
FIG. 7B is a side sectional view of the elevation turret chassis subassembly of FIG. 8A taken along the line 7B-7B, in accordance with embodiments of the disclosure.

FIGS. 7A and 7B illustrate an elevation turret chassis subassembly 230. In an embodiment, an elevation turret chassis subassembly 230 is in accordance with the embodiments shown and described in U.S. Pat. No. 8,919,026. More particularly, the turret chassis subassembly is assembled by inserting a locking gear 206 into the turret chassis 100 on top of the elevation cam disc 160. The elevation turret chassis subassembly is shown in the locked position in FIG. 7B.

The locking gear 206 has a top 208 and a bottom 210. The top 208 defines three mount holes 216 with threads 218. The locking gear also defines three smooth mount holes 220 and a central smooth bore 222. The bottom 210 of the locking gear defines a toothed surface 214. The toothed surface 214 extends downward below the bottom 210 of the locking gear to encircle the reduced radius portion 166 of the top 162 of the elevation cam disc 160 when the turret chassis subassembly is assembled. In one embodiment, the toothed surface 214 has 100 teeth to mesh precisely with the 100 teeth of the toothed surface 108 on the interior perimeter 102 of the turret chassis 100 when the elevation turret 22 is locked.

Four ball bearings 226 protrude outwards from bores 232 in the exterior perimeter 212 located between the toothed surface and the top. Springs 400 behind the ball bearings outwardly bias the ball bearings such that the ball bearings are biased to engage with the upper click groove 104 and lower click groove 106 on the interior perimeter 102 of the turret chassis 100. When the locking gear rises and lowers as the elevation turret 22 is unlocked and locked, the ball bearings travel between the lower and upper click grooves, thereby providing a vertical, resistant force and making a characteristic clicking sound.

When the turret chassis subassembly 230 is assembled, screws 224 are inserted into the mount holes 220 and protrude from the bottom 210 of the locking gear 206. The screws are then screwed into the mount holes 180 in the top 162 of the elevation cam disc 160 to mount the locking gear to the elevation cam disc. Subsequently, the locking gear 206 remains in a fixed rotational position with respect to the elevation cam disc when the elevation turret 22 is unlocked and rotated. The heads 234 of the screws 224 are much thinner than the depth of the mount holes 220 from the top 208 of the locking gear to the shoulders 236. The screws 224 have shoulders 228 that contact the top 162 of the elevation cam disc 160 when the screws are secured. As a result, the locking gear 206 is free to be raised until the heads of the screws contact the shoulders 236 and to be lowered until the bottom of the locking gear contacts the top of the elevation cam disc. This vertical movement is sufficient for the toothed surface 214 of the locking gear to be raised above the toothed surface 108 of the turret chassis 100, thereby enabling the elevation turret to be unlocked and free to rotate.

Figure 8A:
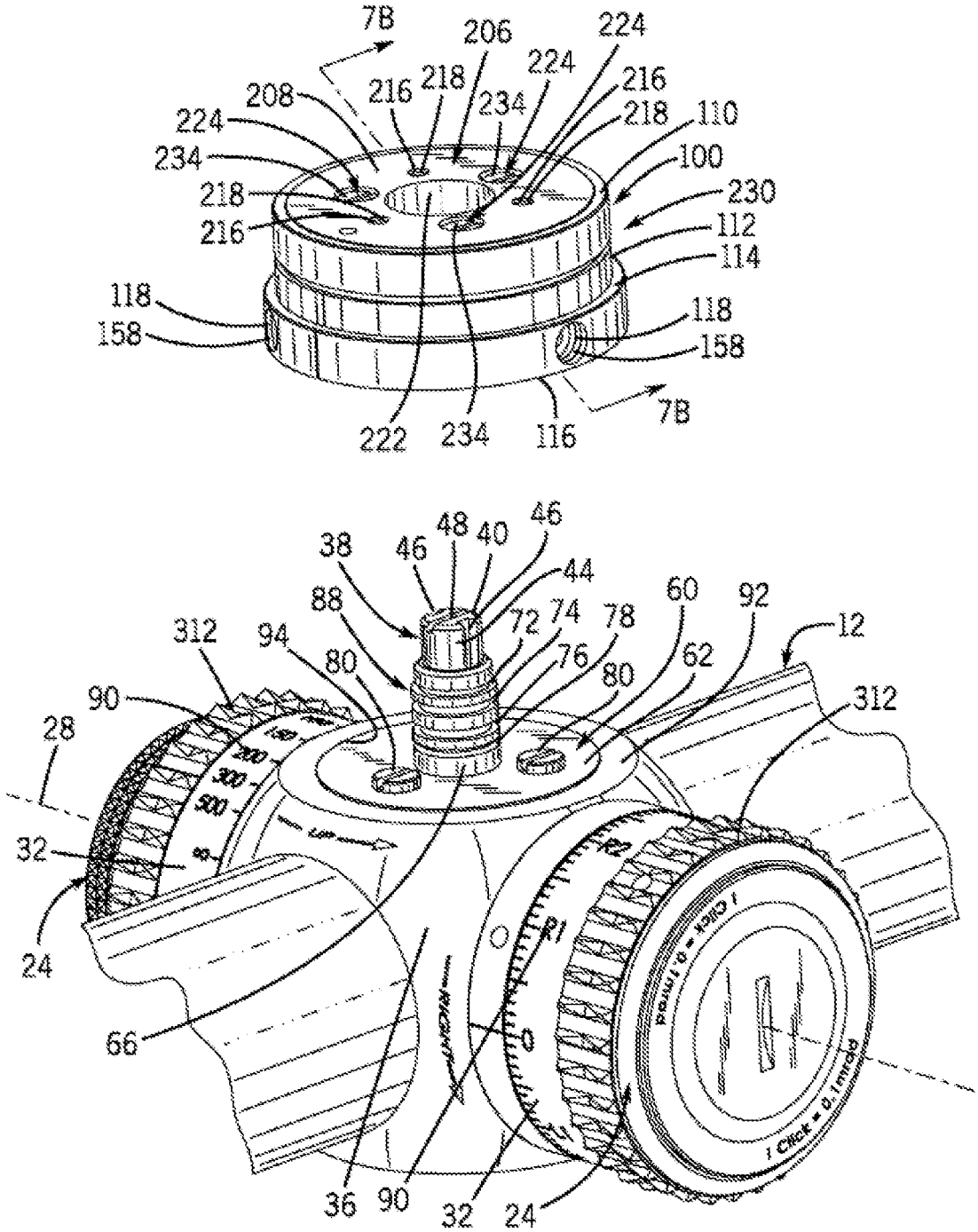
FIG. 8A is a top perspective exploded view of the elevation turret chassis subassembly, elevation turret screw subassembly, and turret housing, in accordance with embodiments of the disclosure.
Figure 8B:
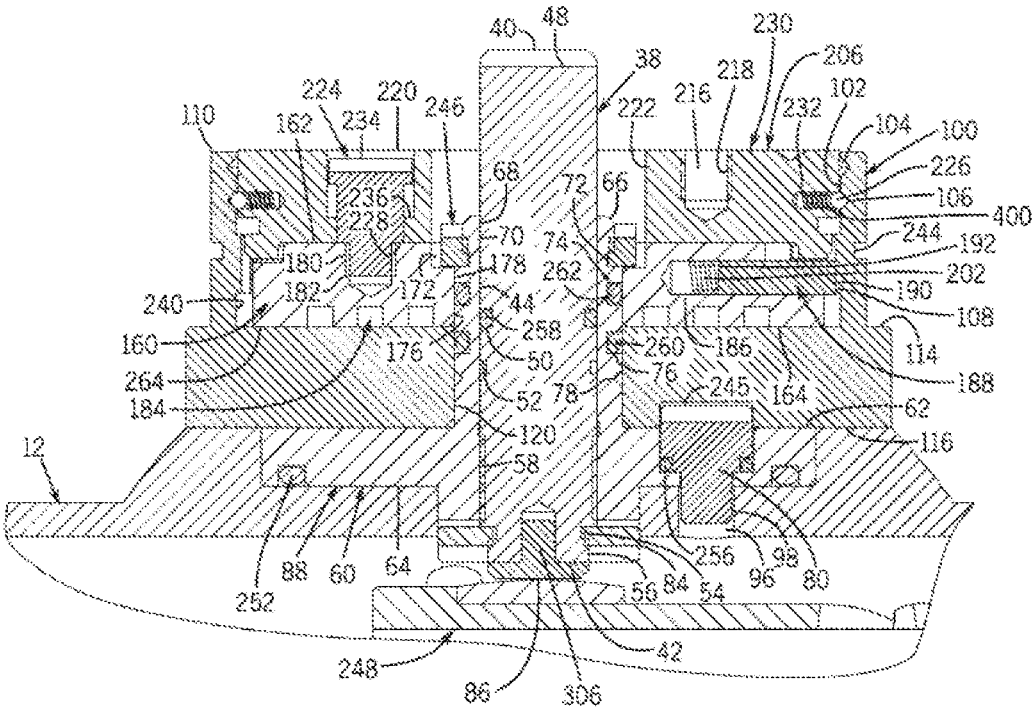
FIG. 8B is a side sectional view of the elevation turret chassis subassembly, elevation turret screw subassembly, and turret housing, in accordance with embodiments of the disclosure.

FIGS. 8A and 8B illustrate an elevation turret chassis subassembly 230, turret screw subassembly 88, and turret housing 36. In an embodiment, an elevation turret chassis subassembly 230, turret screw subassembly 88, and turret housing 36 are in accordance with the embodiments shown and described in U.S. Pat. No. 8,919,026. More particularly, the turret chassis subassembly is shown assembled and in the process of being mounted on the turret screw subassembly in FIG. 8A and mounted on the turret screw subassembly in FIG. 8B.

When the elevation turret chassis subassembly 230 is mounted on the turret screw subassembly 88, the top 40 of the turret screw 38 and the collar 66 of the turret screw base 60 pass upwards through the smooth central bore 120 of the turret chassis 100, the smooth central bore 178 of the elevation cam disc 160, and the central smooth bore 222 of the locking gear 206. A retaining ring 246 is received by the ring slot 72 in the collar to prevent the elevation turret chassis subassembly from being lifted off of the turret screw subassembly. Three recesses 245 in the bottom 116 of the turret chassis receive the heads of the screws 80 that protrude from the top 62 of the turret screw base 60 so the bottom 116 of the turret chassis can sit flush against the top 92 of the turret housing 36.

FIGS. 9A-9D illustrate a zero-adjustment assembly 650. In the embodiment shown, the zero-adjustment assembly 650 is used in combination with a turret structure 22 as shown and describe with reference to FIGS. 1-8B. According to embodiments of the disclosure, a zero-adjustment assembly 650 includes a zero-adjustment dial 266 and a locking collar 605.

In the embodiment shown, the elevation turret 22 is shown with the outer knob 268 over the turret chassis 100 so that the bottom 272 of the outer knob 268 rests against the shoulder 114 of the turret chassis 100. The top 270 of the outer knob 268 defines a recess in which the locking collar 605 and zero-adjustment dial 266 are contained. The top 270 of the outer knob 268 also defines one or more mount holes (not shown) that receive screws (not shown), which engage mount holes 216 in the top 208 of the locking gear 206 (see FIG. 7A). In some embodiments, the perimeter of the outer knob 268 has one or more holes 300 in the textured or knurled portion 310. In the particular embodiment shown in FIGS. 9A-9D, the textured portion 310 is ribbed. In other embodiments, the texture portion 310 is knurled. The recess 274 of the outer knob 268 receives the zero-adjustment dial 266 when the elevation turret 22 is assembled. The zero-adjustment dial 266 is a disc with a downward facing central shaft 286. The shaft 286 interfaces with the turret screw 38. In the particular embodiment shown, the shaft 286 interfaces with the turret screw 38 via an interface component 600. However, in further embodiments, the turret screw 38 may include one or more structures that accomplish the interfacing. When the elevation turret 22 is assembled, the shaft 286 is received by the central bore of the outer knob 268 and the bore 222 in the locking gear 206 (see FIGS. 7A and 7B).

Figure 9A:
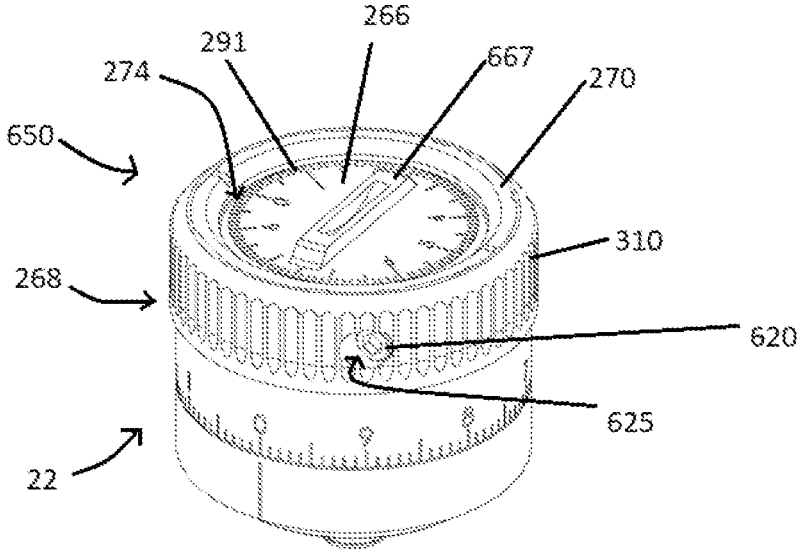
FIG. 9A is a top perspective view of an elevation turret showing a zero-adjust dial and outer knob, in accordance with embodiments of the disclosure.
Figure 9B:
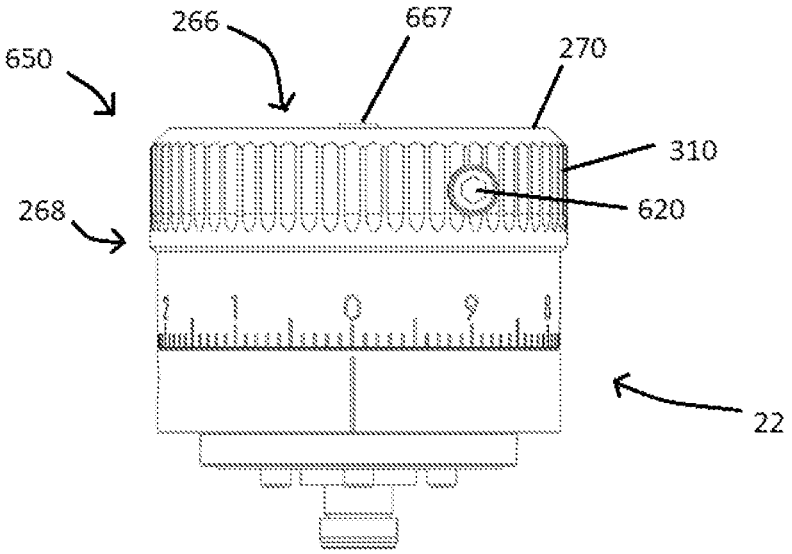
FIG. 9B is a side view of a fully assembled elevation turret with a zero-adjust dial and outer knob, in accordance with embodiments of the disclosure.
Figure 9C:
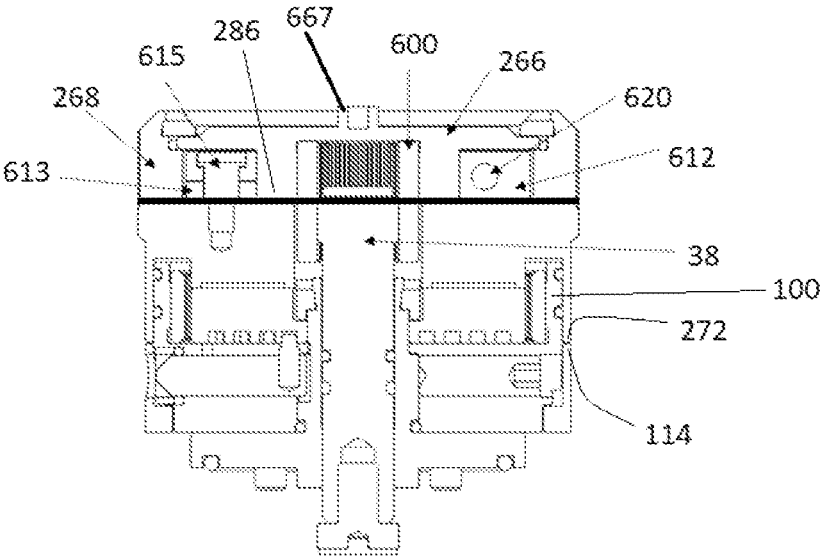
FIG. 9C is a side sectional view of the zero-adjust dial, elevation outer knob, elevation turret chassis subassembly, and elevation turret screw subassembly of FIG. 1 taken along the line 9C-9C, in accordance with embodiments of the disclosure.
Figure 9D:
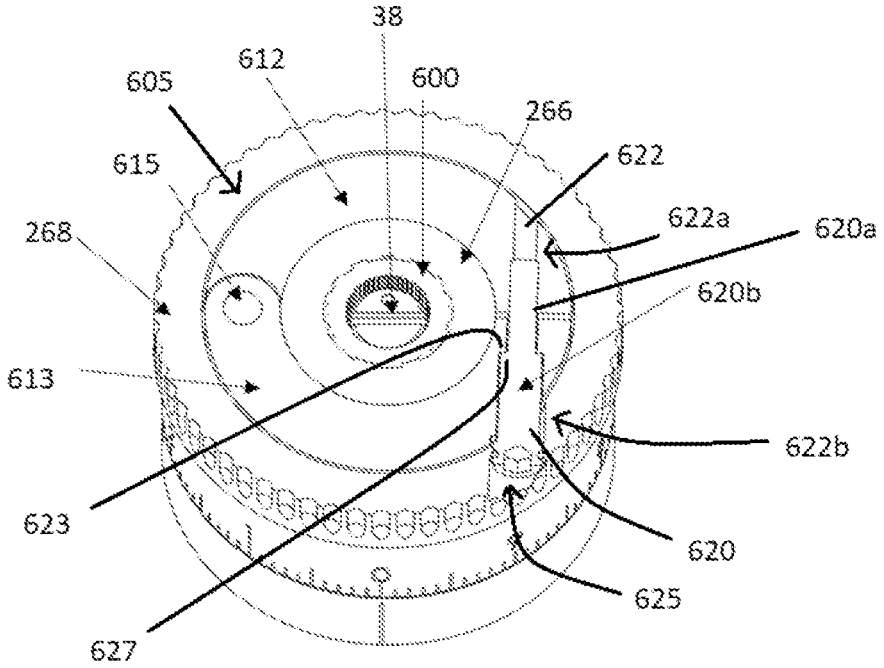
FIG. 9D is a side view of an elevation turret with the zero-adjust dial removed, in accordance with embodiments of the disclosure.

The locking collar 605 is composed of two ring halves 612, 613, which are joined at one end using a mounting screw 615. The mounting screw 615 also acts as a pivot point and rotationally secures the locking collar 605 to the outer knob 268. The two halves 612, 613 of the locking collar 605 pivot at the mounting screw 615 as a function of the clamping screw 620. The clamping screw 620 is offset from the axis of the turret screw 38. As shown in FIG. 9D, the clamping screw 620 extends into a channel 622 through both halves 612, 613 of the locking collar 605 at their ends opposite the mounting screw 615, with an end of the clamping screw 620 accessible via an aperture 625 in the diameter of the outer knob 268. When the clamping screw 620 is tightened, the two halves 612, 613 of the locking collar 605 are drawn together to grip the outer diameter of the zero-adjustment dial 266. Free rotation of the zero-adjustment dial 266 is therefore prevented, and any rotation is coupled to the adjustments made with the primary turret system. When the clamping screw 620 is loosened, the zero-adjustment dial 266 is freely movable in the recess 274 of the outer knob 268. A user can then freely set their zero. In the embodiment shown, the zero-adjustment dial 266 includes a slot 667 shaped to receive a straight blade screwdriver, but could be shaped to receive a hex key or any other suitable type of driver.

More specifically, the channel 622 has two portions 622*a*, 622*b* having different internal diameters. The first portion 622*a* has a first internal diameter $D_1$ and is located in the first half 612 of the locking collar 605. The second portion 622*b* has a second internal diameter $D_2$ and is located in the second half 613 of the locking collar 605. The first internal diameter $D_1$ is less than the second internal diameter $D_2$. The first internal diameter $D_1$ is also threaded. The change in diameter from the first portion 622*a* to the second portion 622*b* results in a shoulder 623 in the channel 622. The clamping screw 620 likewise has two portions. A first portion 620*a* has a first outer diameter $O_1$ corresponding to the internal diameter $D_1$ of the first portion 622*a* of the channel 622. A second portion 620*b* has a second outer diameter $O_2$ corresponding to the internal diameter $D_2$ of the second portion 622*b* of the channel 622. A resulting screw shoulder 627 is also formed that corresponds to the shoulder 623 of the channel 622. When the clamping screw 620 is rotated, the threads of the first portion 622*a* of the channel 620 engage the threads of the first portion 620*a* of the clamping screw 620*a* to move the second half 614 of the locking collar 605. When the clamping screw 620 is tightened, the shoulders 623, 627 contact and the clamping screw 620 presses against the shoulder 623.

By using a single screw (the clamping screw 620), the ease of adjustment is improved compared to riflescopes that use two or more screws to secure a zero-adjustment dial. Moreover, set screws that physically contact the zero-adjustment dial itself can cause damage because of their small contact area and resulting high pressure. Not only do set screws have a tendency to damage a zero-adjustment dial, but the indentations or dimples caused from the set screws often prevent accurate adjustments because the set screws will settle into the indentations or dimples. Further still, when multiple set screws are used, best results are obtained when each is tightened with equal torque. This is difficult to accomplish, particularly when a user is in a hurry.

Figure 10:
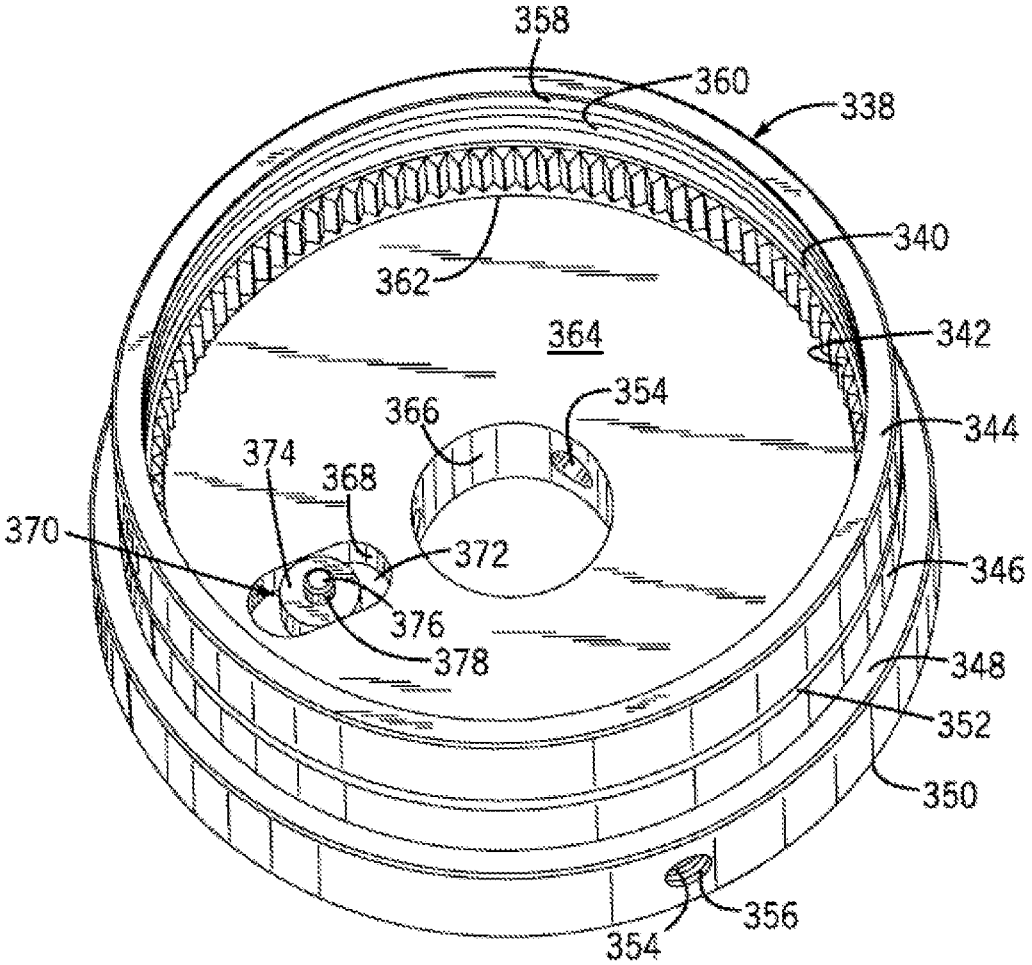
FIG. 10 is a top perspective view of a windage turret chassis, in accordance with embodiments of the disclosure.

FIG. 10 illustrates an improved windage turret chassis 338. More particularly, the top 344 of the windage turret chassis has an interior perimeter 340 with a relief cut 362 adjacent to the floor 364, a toothed surface 342 above the relief cut, a lower click groove 360 above the toothed surface, and an upper click groove 358 above the lower click groove. The floor defines a smooth central bore 366 and a slot 368. The smooth central bore permits passage of the friction pad 478 and the bottom 468 of the turret screw 446 through the turret chassis.

The exterior perimeter 346 of the turret chassis 338 defines 0-ring groove 352. Near the bottom 350 of the turret chassis, the exterior perimeter widens to define a shoulder 348. Three holes 354 with threads 356 communicate from the exterior perimeter through the turret chassis to the smooth bore 366. In one embodiment, the turret chassis is made of steel.

The slot 368 in the floor 364 of the turret chassis 338 receives the bottom 372 of a cam pin 370. In one embodiment, the cam pin is a cylindrical body made of steel. The top 376 of the cam pin has a reduced radius portion 378 that defines a shoulder 374. The reduced radius portion of the cam pin protrudes upward through the slot 368 above the floor 364 of the turret chassis 338.

Figure 11:
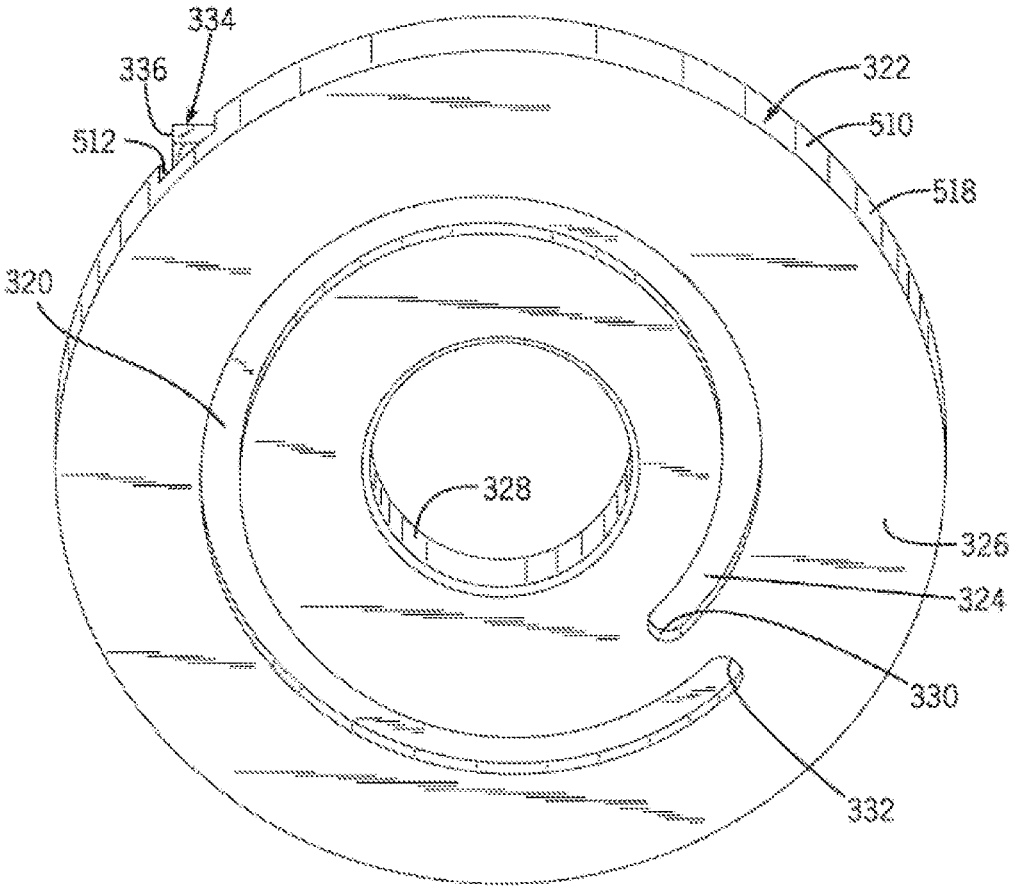
FIG. 11 is a bottom perspective view of the windage cam disc of FIG. 10, in accordance with embodiments of the disclosure.

FIG. 11 illustrates an improved windage cam disc 322. More particularly, the windage cam disc is made of steel with a top 510 and a bottom 326. The top has a reduced radius portion 514 that defines a shoulder 516 around the exterior perimeter 518 of the windage cam disc. The top also defines three mount holes 522 with threads 524. A reduced radius central portion 502 defines a shoulder 526 and a smooth central bore 328. The smooth central bore permits passage of the friction pad 478 and the bottom 468 of the turret screw 446 through the windage cam disc.

A clicker channel 512 in the top 510 of the exterior perimeter 518 receives a clicker 334. The front 336 of the clicker protrudes from the exterior perimeter. In one embodiment, the clicker is made of steel.

The bottom 326 of the windage cam disc 322 is a planar surface perpendicular to the windage turret rotation axis 28 that defines a recessed spiral channel 324. The spiral channel terminates in an end of travel stop surface 330 when traveled in a clockwise direction and terminates in an end of travel stop surface 332 when traveled in a counterclockwise direction. When traveled in a counterclockwise direction, the spiral channel gradually moves outwards from the bore 328 so the spiral channel can slightly overlap itself. The spiral channel is adapted to receive the reduced radius portion 130 of the cam pin 126. The spiral channel and the stop surfaces are integral to the windage cam disc and are not adjustable. To provide a full 360° of rotation, the center points of the semi-circular ends of the channel are at the same rotational position on the disc, at different radial distances from the center of the disc. More than 360° of rotation could also be provided as described with respect to the elevation cam disc 160 above.

When the windage cam disc 322 is installed in the turret chassis 338, the spiral channel 324 receives the reduced radius portion 378 of the cam pin 370. The clicker 334 protrudes from the clicker channel 512 in the exterior perimeter 518 of the windage cam disc. A spring 412 at the rear 410 of the clicker outwardly biases the clicker such that the clicker is biased to engage with the toothed surface 342 on the interior perimeter 340 of the turret chassis. When the windage cam disc rotates as the windage turret 24 is rotated when changing windage settings, the clicker travels over the toothed surface, thereby providing a rotational, resistant force and making a characteristic clicking sound.

In one embodiment, the toothed surface 342 has 100 teeth, which enables 100 clicks per rotation of the windage turret 24. The windage turret 24 is positioned at the indicium 90 corresponding to 0° of adjustment when the cam pin 370 is located at the midpoint 320 of the spiral channel 324. The spiral channel holds the cam pin 126 in an arc segment at a constantly increasing distance from the rotation axis 28. The spiral channel 324 permits one-half of a revolution either clockwise or counterclockwise from the zero point 320, which is 5 mrad in one embodiment. At that time, the cam pin is flush with an end of travel stop surface, and further rotation of the windage turret and windage adjustment are prevented. The spiral channel 324 could be reconfigured to allow various other mrads of travel from the zero point 320.

It will be appreciated that an assembled windage turret 24 is substantially identical in construction to an elevation turret 22, as shown and described herein, except for the changes to the spiral cam disc 322 and elimination of the elevation indicator. Although the windage turret could similarly include a windage indicator and spiral cam disc with more than one revolution, in practice, one revolution of the turret has been sufficient to adjust for lateral sighting adjustments. Importantly, a windage turret can include the zero-adjustment assembly 600 as shown and described with reference to FIGS. 9A-9D.

Figure 12A:
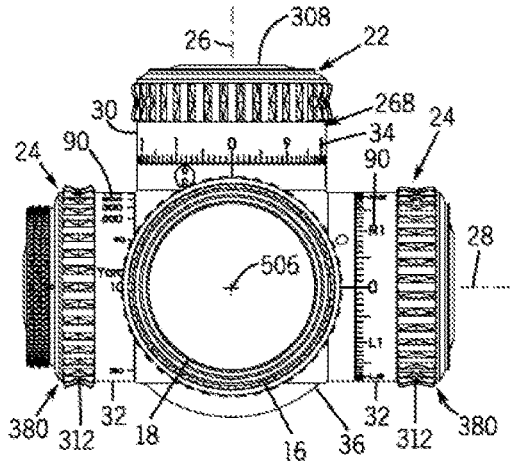
FIG. 12A is a rear view of the riflescope with adjustment stops of FIG. 1 with the elevation turret in the locked position, in accordance with embodiments of the disclosure.
Figure 12B:
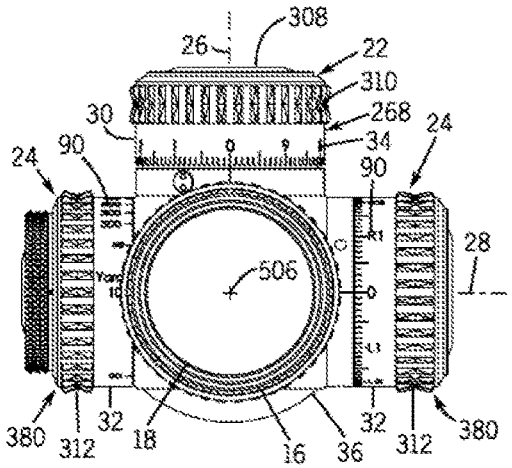
FIG. 12B is a rear view of the riflescope with adjustment stops of FIG. 1 with the elevation turret in the unlocked position, in accordance with embodiments of the disclosure.

FIGS. 12A, 12B, 13A, and 13B illustrate a riflescope turret with spiral cam mechanism 10. More particularly, the riflescope 10 is shown in use. FIGS. 12A and 12B show the elevation turret 22 in the locked and unlocked positions, respectively. The elevation turret is unlocked by raising it parallel to the rotation axis 26. This upward motion disengages the toothed surface 214 of the locking gear 206 from the toothed surface 108 of the turret chassis 100. The elevation turret is then free to rotate to the extent permitted by the spiral channel 184 in the elevation cam disc 160. Lowering the elevation turret engages the toothed surface of the locking gear 206 with the toothed surface 108 of the turret chassis. This downward motion returns the elevation turret to the locked position.

When "0" on the outer knob 268 is facing the user, the cam pin 126 is resting against the zero stop surface 198, which prevents any further downward adjustment of the turret screw 38. Zero on the outer knob is the distance the riflescope 10 is sighted in at when no clicks have been dialed in on the elevation turret and references the flight of the projectile. If the riflescope is sighted in at 200 yards, it is said to have a 200 yard zero.

When the elevation turret 22 is unlocked, the user rotates the elevation turret counterclockwise for longer range shots than the sight-in distance of the riflescope 10. Rotation of the turret adjusts the amount of the turret screw 38 that extends from the bottom of the turret.

The turret applies a downward force in the form of elevation pressure to the moveable optical element via a friction pad. The windage turret 24 applies a sideways force in the form of windage pressure to the movable optical element via a further friction pad. These forces are balanced by a biasing spring pressure applied to the moveable optical element by a biasing spring at an angle of about 135° with respect to both the elevation pressure and the windage pressure.

Figure 13A:
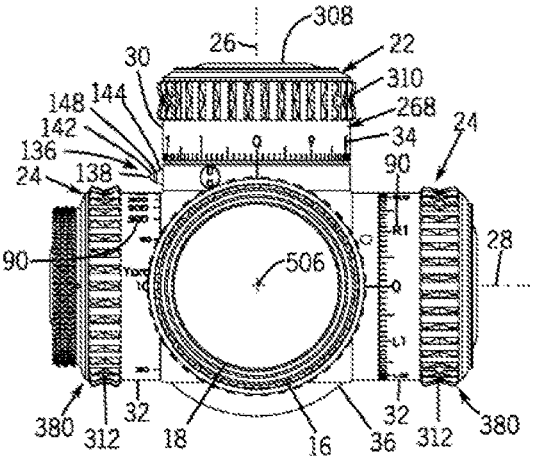
FIG. 13A is a rear view of the riflescope with adjustment stops of FIG. 1 with the elevation turret having made one rotation, in accordance with embodiments of the disclosure.
Figure 13B:
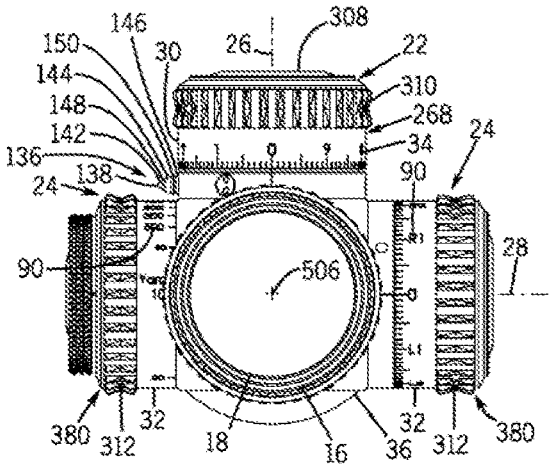
FIG. 13B is a rear view of the riflescope with adjustment stops of FIG. 1 with the elevation turret having made two rotations, in accordance with embodiments of the disclosure.

Once a full revolution is made on the elevation turret 22, the elevation indicator 136 pops out from hole 124 in the exterior perimeter 112 of the turret chassis 100. The position of the elevation indicator after one revolution is shown in FIG. 13A, in which the first position 142, stripe 148, and second position 144 are visible. After a second revolution is made on the elevation turret, the elevation indicator extends further outwards radially as shown in FIG. 13B, in which the stripe 150 and a portion of the third position 146 are newly visible. When the user dials the turret back down by rotating the turret clockwise, the indicator retracts back into the turret chassis. As a result, the indicator provides both visual and tactile indication to the user of which of the nearly three revolutions the elevation turret is on.

The windage turret functions substantially identically to the elevation turret except for lacking an elevation indicator. Although the windage turret could similarly include a windage indicator, in practice, one revolution of the turret has been sufficient to adjust for lateral sighting adjustments.

Figure 14:
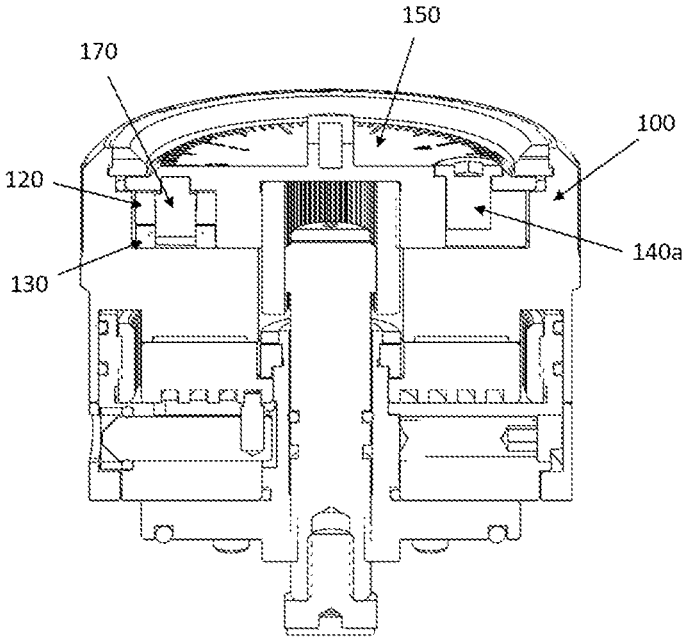
FIG. 14 is a schematic of a representative embodiment showing a side cross section of the split rung halves coupled to the zero adjustment dial and their location relative to the main turret cap and the modified locking screw.
Figure 15:
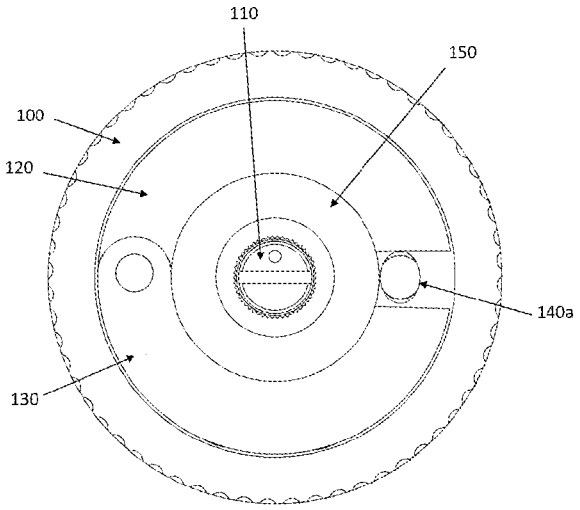
FIG. 15 is a schematic of a representative embodiment showing a top cross section of the split rung halves coupled to the zero adjustment dial and their location relative to the main turret cap and the modified locking screw. The cam feature of 140*a* is shown here.

FIGS. 14 and 15 depict a further embodiment of the turret disclosed herein. In another embodiment, the "locking collar" feature could be used in a handful of other ways. For example, the locking collar could be activated by a means other than the screw, such as a cam or wedge. Alternatively, the locking collar could be operated in the opposite orientation, locking when the split ring is expanded. This embodiment is considered in more detail in the following images.

In one embodiment disclosed above, the locking collar was actuated by a screw accessible through the main turret cap and clamped upon the zero adjustment dial. In another representative embodiment depicted in FIGS. 14 and 15, the locking collar (shown in FIGS. 14 and 15 as 120 and 130) is coupled to the zero adjustment dial (shown in FIGS. 14 and 15 as 150) such that the whole assembly would rotate with the adjustment of the zero adjustment dial (shown in FIGS. 14 and 15 as 150). In order to lock the rotation of the zero adjustment dial (shown in FIGS. 14 and 15 as 150) relative to the main turret cap (shown in FIGS. 14 and 15 as 100), the user would engage the locking screw (shown in FIGS. 14 and 15 as 140*a*). The locking screw (shown in FIGS. 14 and 15 as 140*a*) is shaped such that it causes the two halves of the split ring (shown in FIGS. 14 and 15 as 120 and 130) to spread apart. The outer diameters of the split ring halves (shown in FIGS. 14 and 15 as 120 and 130) would then deliberately interfere with the side wall of the main turret cap (shown in FIGS. 14 and 15 as 100) and lock the whole zero adjustment dial/split ring assembly in place, preventing further rotational adjustment. The locking screw (shown in FIGS. 14 and 15 as 140*a*) could take the form of a cam as shown, but it could just as easily be a wedge or another simple machine used to expand the locking collar.

In one embodiment, the split ring halves are rotationally coupled to the zero adjustment dial. In another embodiment, the split ring halves are rotationally coupled to the main turret cap.

While multiple embodiments of the riflescope turret with adjustment stops, rotation indicator, locking mechanism and/or multiple knobs have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A riflescope comprising:

a scope body;

a movable optical element defining an optical axis connected to the scope body;

a turret having an outer knob and a turret screw defining a screw axis and operably connected to the optical element for changing the optical axis in response to rotation of the turret screw; and a zero-adjustment assembly contained within the turret and operably interfacing with the turret screw, the zero-adjustment assembly comprising a zero-adjustment disc and a locking collar disposed around a downward facing central shaft of the zero-adjustment disc, wherein the locking collar comprises a first ring half and a second ring half pivotally joined at respective first ends, the locking collar further comprising a channel extending through respective second ends of the first and second ring halves, wherein the zero-adjustment disc is contained in an upper recess of the outer knob.

2. The riflescope of claim 1, wherein the locking collar has a first position and a second position, and wherein the zero-adjustment disc is freely rotatable about the turret screw when the locking collar is in the first position and free rotation of the zero-adjustment disc is prevented when the locking collar is in the second position.

3. The riflescope of claim 1, wherein the channel has a first portion having a first internal diameter and a second portion having a second internal diameter, wherein the first internal diameter is less than the second internal diameter.

4. The riflescope of claim 3, wherein the second portion of the channel is threaded and a screw engages the channel.

5. The riflescope of claim 4, wherein rotation of the screw in a first direction causes pivotal movement of the second ends of the first and second ring halves away from one another to move the locking collar to the first position and rotation of the screw in a second direction causes pivotal movement of the second ends of the first and second ring halves toward one another to move the locking collar to the second position.

6. The riflescope of claim 5, wherein the screw is accessible through a side surface of the outer knob.

7. The riflescope of claim 2, wherein the turret is an elevation turret.

8. The riflescope of claim 2, wherein the turret is a windage turret.

9. A riflescope comprising:

a scope body;

a movable optical element defining an optical axis connected to the scope body;

a turret having an outer knob and a turret screw defining a screw axis and operably connected to the optical element for changing the optical axis in response to rotation of the turret screw;

a guide surface wrapping about the screw axis and terminating at first and second ends;

a cam follower element connected to the scope body and operable to engage the guide surface, and to engage the first and second ends, the engagement of the first and second ends defining the rotational limits of the turret;

wherein each of the first and second ends are at different radial distances from the screw axis;

wherein the cam follower is moved radially in relation to the screw axis and prevented from rotating; and a zero-adjustment assembly contained within the turret and operably interfacing with the turret screw, the zero-adjustment assembly comprising a zero-adjustment disc and a locking collar disposed around a downward facing central shaft of the zero-adjustment disc, wherein the locking collar comprises a first ring half and a second ring half pivotally joined at respective first ends, the locking collar further comprising a channel extending through respective second ends of the first and second ring halves, wherein the zero-adjustment disc is contained in a upper recess of the outer knob.

10. The riflescope of claim 9, wherein the locking collar has a first position and a second position, and wherein the zero-adjustment disc is freely rotatable about the turret screw when the locking collar is in the first position and free rotation of the zero-adjustment disc is prevented when the locking collar is in the second position.

11. The riflescope of claim 9, wherein the channel has a first portion having a first internal diameter and a second portion having a second internal diameter, wherein the first internal diameter is less than the second internal diameter.

12. The riflescope of claim 11, wherein the second portion of the channel is threaded and a screw engages the channel.

13. The riflescope of claim 12, wherein rotation of the screw in a first direction causes pivotal movement of the second ends of the first and second ring halves away from one another to move the locking collar to the first position and rotation of the screw in a second direction causes pivotal movement of the second ends of the first and second ring halves toward one another to move the locking collar to the second position.

14. The riflescope of claim 13, wherein the screw is accessible through a side surface of the outer knob.

15. The riflescope of claim 9, wherein the turret is an elevation turret or a windage turret.

16. A riflescope comprising:

a scope body;

a movable optical element defining an optical axis connected to the scope body;

a turret having an outer knob and a turret screw defining a screw axis and operably connected to the optical element for changing the optical axis in response to rotation of the turret screw; and a zero-adjustment assembly contained within the turret and operably interfacing with the turret screw, the zero-adjustment assembly comprising a zero-adjustment disc contained in an upper recess of the outer knob, a locking collar disposed around a downward facing central shaft of the zero-adjustment disc, the locking collar comprising a first ring half and a second ring half pivotally joined at respective first ends and a channel extending through respective second ends of the first and second ring halves, and a screw engaging the channel;

wherein rotation of the screw in a first direction causes pivotal movement of the second ends of the first and second ring halves away from one another to move the locking collar to a first position in which the zero-adjustment disc is freely rotatable about the turret screw, and wherein rotation of the screw in a second direction causes pivotal movement of the second ends of the first and second ring halves toward one another to move the locking collar to a second position in which free rotation of the zero-adjustment disc is prevented.

* * * * *